United States Patent [19]

Rickert

[11] 4,114,396

[45] Sep. 19, 1978

[54] REFRIGERATION EVAPORATOR COIL WITH NON-FROSTING FINS

[76] Inventor: Glenn E. Rickert, Community Bank Building, Huntington, Ind. 46750

[21] Appl. No.: 763,874

[22] Filed: Jan. 31, 1977

Related U.S. Application Data

[63] Continuation-in-part of Ser. No. 716,789, Aug. 23, 1976.

[51] Int. Cl.[2] ..... F25D 17/04; F25D 11/00; F25D 3/10; F28D 13/00

[52] U.S. Cl. ..... 62/406; 62/430; 62/529; 165/104 S

[58] Field of Search ..... 62/59, 406, 430, 529, 62/393; 165/104 S

[56] References Cited

U.S. PATENT DOCUMENTS

| | | | |
|---|---|---|---|
| 1,768,569 | 7/1930 | Claiborne | 62/406 |
| 2,020,093 | 11/1935 | Anderson | 62/406 |
| 2,674,101 | 4/1954 | Calling | 62/59 |

FOREIGN PATENT DOCUMENTS

| | | | |
|---|---|---|---|
| 2,237,757 | 2/1974 | Fed. Rep. of Germany | 62/59 |

*Primary Examiner*—Lloyd L. King
*Attorney, Agent, or Firm*—Gust, Irish, Jeffers & Rickert

[57] ABSTRACT

A non-frosting heat absorption system is disclosed for temperature stabilizing the heat absorbing surfaces thereof and includes a heat absorption arrangement such as a refrigeration system evaporator coil having a first series of heat exchange surfaces in good heat transfer relation therewith. A second series of heat exchange surfaces have portions thereof in good heat transfer relationship with a heat load such as air circulated thereby and other portions thereof immersed in and coupled to the first series of heat exchange surfaces by a heat storage arrangement including a phase change material such as water. The phase change material then permits the transfer of heat from the second series of surfaces to the first series of surfaces while allowing the second series of surfaces to be maintained near the phase change temperature of the material during various heat load conditions. The phase change material forms the sole heat transferring connection between the two series of surfaces and therefore assures that the air exposed series of surfaces do not frost until a substantial quantity of the phase change material has first been solidified.

7 Claims, 2 Drawing Figures

REFRIGERATION EVAPORATOR COIL WITH NON-FROSTING FINS

BACKGROUND OF THE INVENTION

This application is a Continuation-In-Part of my copending application Ser. No. 716,789, filed Aug. 23, 1976, the entire disclosure of which is incorporated herein by reference.

This invention relates to refrigeration coils having fins or surfaces which exchange heat with the air passing over them.

In the present state of the art in order to hold an evaporator coil at near freezing temperatures under varying loads without frosting it sufficiently to render it inoperative due to the restricted air flow, either a re-heat system or a hot gas bypass system is generally employed.

In a re-heat system, cold is continually provided and when that much cold is not needed, excess cold is eliminated by a special heat input such as an electric heater, or by the heat given off by the condenser of the system. Since the compressor runs continually regardless of the external load, it is obviously inefficient and wasteful of energy.

In a hot gas bypass control system the condenser is periodically bypassed and the hot output of the compressor goes directly back into the compressor intake, or goes directly into the evaporator to restrict the cooling capacity of the evaporator. The compressor here also runs continually never turning off. It is also obvious here that this system produces controlled cold rather inefficiently and wastes much electrical energy when serving lighter heat loads than its maximum capacity.

The more commonly used method to limit the output of a refrigeration system when it is loaded to less than its capacity is to cycle the compressor on and off, and cool the evaporator coil spasmodically. If one attempts, however, to use this system to maintain an evaporator coil near freezing but above the frosting temperature, under varying heat loads, it would require such short periods of on and off, that the frequent starts of the compressor would consume excess electricity and these short and frequent cycles could lead to early compressor and accessory control equipment failure.

One object of my invention is to provide a system to hold the air heat exchange fins of a refrigeration evaporator near freezing without frosting them sufficiently to stop the air passage, and to do so over a wide variation of heat loads.

It is a further object of the invention to provide a frost free evaporator employing an ice-water heat sink, which is not damaged by the freezing and thawing of the ice-water.

A prime object of this invention is to provide an energy saving system which can be employed as a dehumidifier having higher efficiency than previously taught by the art.

SUMMARY OF THE INVENTION

The foregoing objects as well as numerous other objects, features and advantages of the present invention are achieved in the preferred form of the invention by providing a refrigeration evaporator coil which has heat conducting freezer fins connected in good heat transfer relationship to the refrigeration evaporator tubing, which freezer fins are at least partially immersed in water and which absorb heat from the water and cause it to freeze.

A second set of fins are provided which are only partially immersed in this ice-water, the upper portion being exposed to the air. These air-water fins absorb heat from the air passing over their air exposed portion and conduct that heat to their water immersed portion to melt the ice in the ice-water.

This ice-water acting as a heat conducting pathway between the closely associated freezer fins and the water portion of the air-water fins also acts as a heat sink temperature stabilizer due to the latent heat capacity of water changing its state between solid and liquid.

Other advantages of the invention will hereinafter become more fully apparent from the following detailed description of a preferred embodiment of the invention when considered in conjunction with the accompanying drawings throughout which like reference characters indicate like parts and in which:

DESCRIPTION OF THE PREFERRED EMBODIMENT

Figure 1:
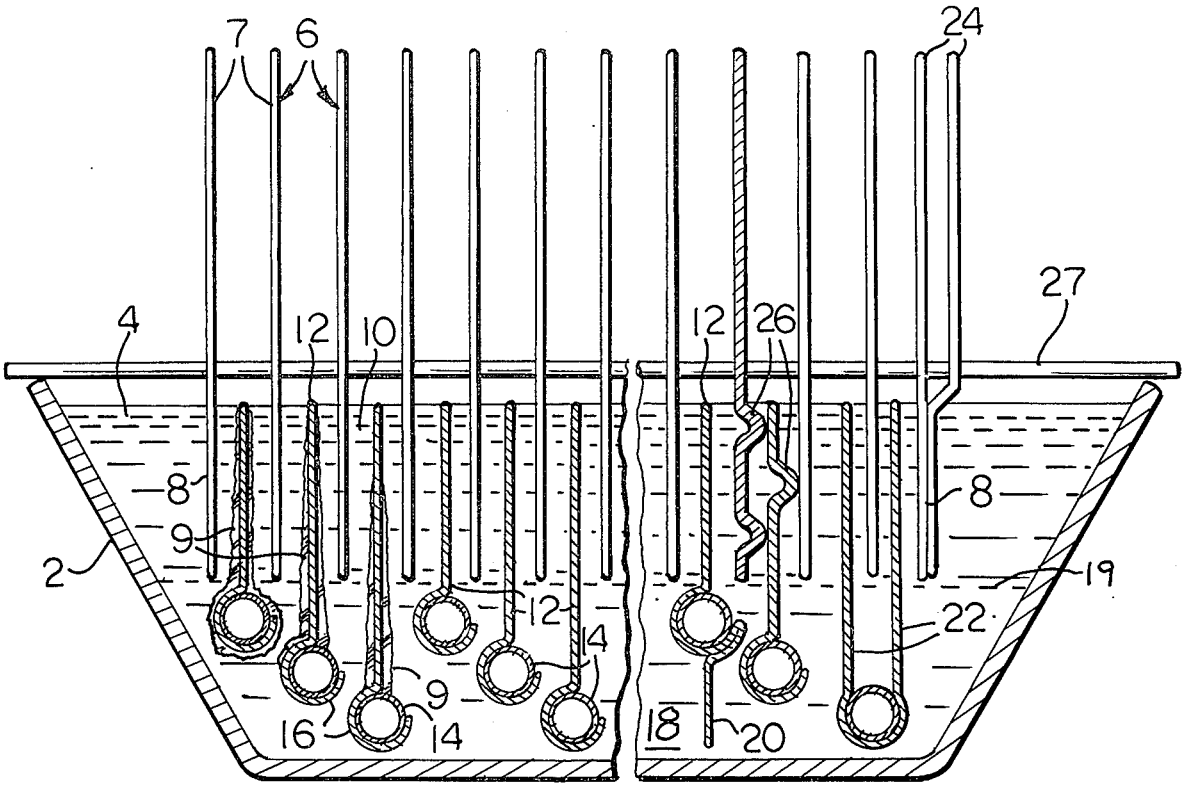
FIG. 1 is a cross-sectional end view of one form of the invention.

FIG. 1 is the preferred form of the invention where the evaporator coil unit has a tray 2 of ice water 4. A series of surfaces in the form of air-water fins 6 act as a heat exchange surface and have an air portion 7 standing in air which is the heat load, and a water portion 8 standing in ice-water. Water 10 is shown in contact with water portion 8 where ice 9 is in close proximity. Another series of surfaces in the form of freezer fins 12 extend from the ice 9 to the heat absorption means shown as refrigeration tubing 14 where it is shown in good heat transfer relationship at 16 by being wrapped around the tubing 14. The area 18 below the dotted line 19 can be filled as shown with ice-water 4 as it is above dotted line 19, or the area 18 below line 19 can instead be filled by other materials. This filling material can be closed cell elastic foam made from plastic, rubber, etc., or can be any other suitable material. If it is elastic in nature it could minimize any expansion problems if they should occur during the freezing of ice-water 4. Support rods 27 or any other suitable support system can be used to position the stack of fins 6.

Dimples or other protrusions 26 on the fins can aid in holding a proper spacing between the fins, or other locating means can be provided. The air portion 7 of the air water fin 6 can be two or more fins 24, connected to a common water portion 8. Double fins in the water can connect to a single portion in the air. Any combination of numbers desired can be used.

The freezer fin 12 can have a downward protruding portion 20 if desired. Two or more freezer fins 22 can project upward from the refrigeration pipes 14. Multiple fin combinations can be used as desired anywhere.

Figure 2:
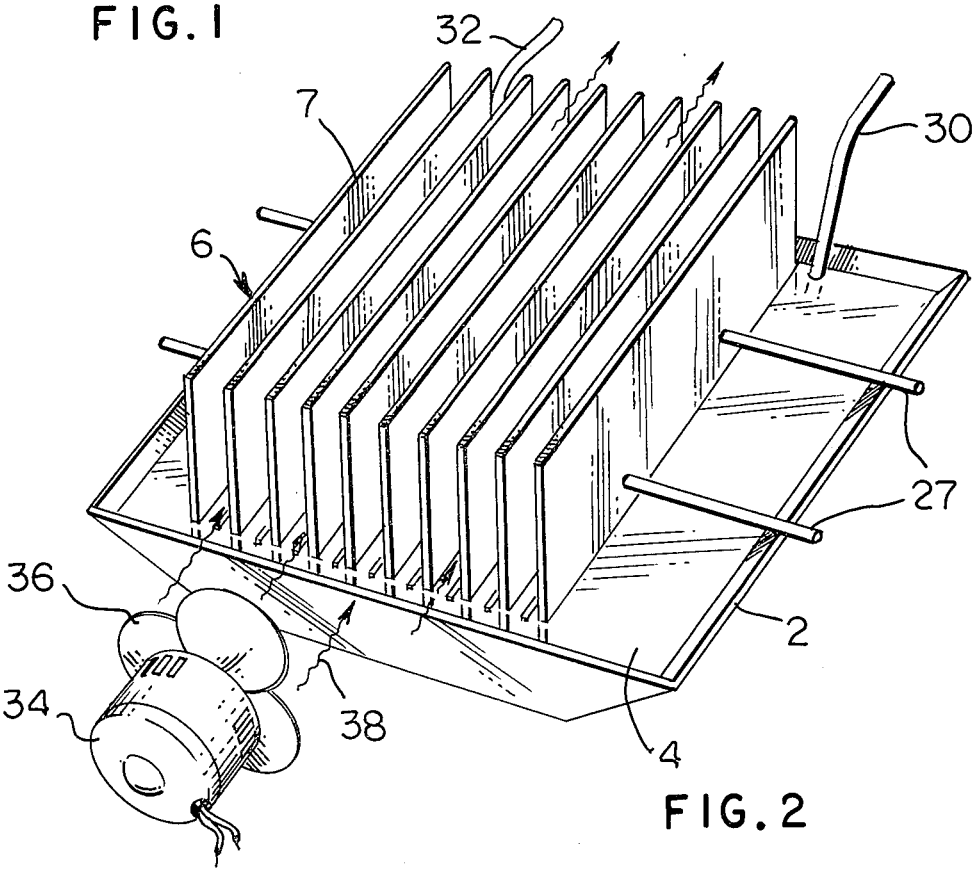
FIG. 2 is a perspective view of the invention showing air passing over the air-water fin surfaces.

FIG. 2 is a perspective view also of the preferred form of the invention, where the tray 2 holds a quantity of ice-water 4 with the air portion 7 of the air-water fins 6 protruding into the air or heat load above the ice-water 4. A fan 36 is driven by a motor 34 to direct air flow heat load 38 across the surfaces of the air portion 7 of the air-water fins 6.

Refrigeration pipes 30, 32 of FIG. 2 are connected to and are an extension of the refrigeration pipes 14 of FIG. 1. These pipes 30, 32 are extended from the unit for convenience in connecting to any desirable refrigerating system. Mechanical, absorption or other cooling systems may be connected to cause cooling material to flow through pipes 30, 32 to cool the ice-water 4. Any cooling source may be used to cause the freezer fins 12 to freeze the water to ice 9.

The functions of the parts individually and as an assembly should now be clear. A cooling refrigerant flows through pipes 14 to cool freezer fins 12, which in turn cools the liquid 10 which can be any heat storage means, but preferably is water. The liquid is cooled sufficient to change at least partly to a solid, which in doing so changes phase, and employs latent heat principles and gives up its stored heat. The first portion of the liquid to change to a solid state is of course adjacent to the freezer fin 12 in a body shown as 9.

As cooling continues, the size of the body of solid or ice 9 increases and the liquid 10 decreases until the space between freezer fin 12 and the water portion 8 of the air-water fin 6 becomes nearly all or completely all a solid, such as ice.

If pure water is chosen as the liquid, and if the unit is being cooled by refrigeration, the temperatures and process involved are something like the following. The surface between the solid 9 and the liquid 10 is of course 32° F. The freezer fin 12 is below 32° F as it is being cooled by the refrigeration pipe 14 which is even colder. The liquid 10 is 32° F or slightly above 32° F. The water portion 8 of the air-water fin 6 is only slightly above that temperature. As heat is conducted downward through the air-water fin 6 from the air stream 38 heat load on the air portion 7 of the fin, the air portion is of course slightly warmer (or less cold) than the water portion 8 of the fin 6.

In a properly proportioned unit with optimum sized good heat conducting materials the air portion 7 of the air-water fin 6 can be maintained at a temperature only slightly above the freezing temperature of the liquid 10 while the refrigeration system is alternately turned on and turned off to freeze and to let thaw the body of liquid 10 occupying the space between the water portion 8 of the air-water fin 6 and the freezer fin 12.

In this freezing and thawing process, much cold or heat is transferred in and out of the ice water due to the latent heat state change capacity of ice water without deviating from about 32° F at the surface of the ice. Therefore, if the distance is reasonably small between the freezer fin 12 surface and the water portion 8 surface of the air-water fin 6, and if the area of each surface is sufficiently large for the heat loads involved, the air portion 7 of the air-water fins 6 can be maintained near 32° F for cooling and/or dehumidifying the air 38 without frosting the air portion 7 surface while the refrigeration system is in its on mode for a considerable time freezing water as well as while the refrigeration is off for a considerable time allowing the ice to melt.

Condensate formed on the air portion of the air-water fins can be used as per my abovementioned copending application to supply and/or maintain the water in the tray, by directing the condensate into the tray.

The freezer fins can be substituted by any suitable surface including the "tinsel" type of air to metal heat transfer, as can be air-water fins, if desired.

In the event any freezing of the heat sink phase change water produces otherwise troublesome expansion problems, the sides of the tray 2 can be designed as shown with sloping sides to direct the expansion in a non-damaging direction. The stack or series of fins can for the same reasons be flexibly located so as to move as demanded by the expansion of freezing.

The refrigeration pipes 14 of FIG. 1 can, for certain uses, extend transverse to the freezer fins 12 instead of being parallel to the fins 12 as shown in FIG. 1. When transverse to the fins 12 the pipes 14 can penetrate the fins 12 in a manner similar to that used in conventional evaporator coils.

Here also as previously described the portion of freezer fin stack containing the refrigeration pipes can be filled, or partially filled, with other material than water. Also, the tray may be filled or partially filled with water according to the principles of my abovementioned copending application. The freezer fin and refrigeration pipe may be made from one extruded piece, or the fin and pipe be otherwise connected.

This invention by its unique design of closely associated plates of opposite heat loads, one being made warmer, one being made colder, can be termed a heat storage battery. This heat storage battery of closely associated plates of opposite heat loads by its unique design can be constructed to have almost any heat storage capacity desired from only a few British Thermal Units per hour to many thousand British Thermal Units per hour. Furthermore, by properly sizing the adjacent plate areas, by properly spacing the plates from each other, and by choosing the proper liquid to change its phase from liquid to solid which connects the plates of opposite heat loads, a very efficient heat storage battery is provided with almost any desired capacity of British Thermal Units, operating over a wide range of temperatures dependent only on the phase change temperature of the material chosen.

This invention is useful for dehumidification, air conditioning, food preservation in a refrigerator, as well as in other cooling needs. A definite advantage of this system in a refrigerator is that it does not freeze out moisture in the cabinet thus providing a more moist, less drying atmosphere for food preservation.

While the basic principle of this invention has been herein illustrated along with one embodiment it will be appreciated by those skilled in the art that variations in the disclosed arrangement both as to its details and as to the organization of such details may be made without departing from the spirit and scope thereof. Accordingly, it is intended that the foregoing disclosure and the showings made in the drawings will be considered only as illustrative of the principles of the invention and not construed in a limiting sense.

What is claimed is:

1. In a heat absorption system, the improvement for temperature stabilizing heat load absorbing surfaces comprising: heat absorption means, a first series of heat exchange surfaces in good heat transfer relationship with said heat absorption means, a second series of heat exchange surfaces in good heat transfer relationship with a heat load, heat storage means including phase change material, said first series of heat exchange surfaces and said second series of heat exchange surfaces disposed generally parallel to one another and interspersed in close proximity to provide a good connection for heat transfer therebetween through said phase change material, said first series of heat exchange surfaces, said second series of heat exchange surfaces, and said phase change material adapted to permit said phase change material to transfer heat from said second series of surfaces to said first series of surfaces so that said second series of heat exchange surfaces can be maintained near the phase change temperature of said material by said heat absorption means during various heat load conditions.

2. The improvement of claim 1 wherein the heat absorption means comprises a refrigeration system evaporator coil.

3. The improvement of claim 1 wherein the phase change material is water.

4. The improvement of claim 3 wherein the second series of surfaces comprise a plurality of plate-like fins, each having a portion immersed in the water and a portion extending from the water.

5. The improvement of claim 4 further comprising means for forcing air past the fin portions which extend from the water to cool that air.

6. The improvement of claim 1 wherein the phase change material is substantially the sole medium for heat transfer between the first series of surfaces and the second series of surfaces.

7. The improvement of claim 6 wherein the first series of surfaces are substantially completely immersed in the phase change material.

* * * * *